US005730946A

United States Patent [19]

Linnarsson

[11] Patent Number: 5,730,946

[45] Date of Patent: Mar. 24, 1998

[54] COMBINED CATALYTIC CONVERTER AND MUFFLER

[75] Inventor: Jan Linnarsson, Malmö, Sweden

[73] Assignee: Dahlmans Klippo AB, Malmo, Sweden

[21] Appl. No.: 596,330

[22] PCT Filed: Aug. 23, 1994

[86] PCT No.: PCT/SE94/00763

§ 371 Date: Jun. 6, 1996

§ 102(e) Date: Jun. 6, 1996

[87] PCT Pub. No.: WO95/06193

PCT Pub. Date: Mar. 2, 1995

[30] Foreign Application Priority Data

Aug. 23, 1993 [SE] Sweden ..... 9302712

[51] Int. Cl.[6] ..... B01D 53/94

[52] U.S. Cl. ..... 422/177; 60/322; 181/213; 181/214; 422/168

[58] Field of Search ..... 422/168, 177; 60/322; 181/214, 213

[56] References Cited

U.S. PATENT DOCUMENTS

| | | | |
|---|---|---|---|
| 3,642,095 | 2/1972 | Fujii | 181/57 |
| 4,050,903 | 9/1977 | Bailey et al. | 23/288 |
| 4,105,090 | 8/1978 | Tachihana et al. | 181/265 |
| 4,116,303 | 9/1978 | Trudell | 181/252 |
| 4,148,860 | 4/1979 | Goedicke | 422/176 |
| 4,209,493 | 6/1980 | Olson | 422/176 |

*Primary Examiner*—Dorothy McMahon
*Attorney, Agent, or Firm*—Ladas & Parry

[57] ABSTRACT

The invention relates to combined catalytic converter and muffler device intended for attachment to the exhaust pipe of an engine, e.g. on a lawn mower. The device comprises a housing within which a catalytic substance (14) is arranged. According to the invention, the exhaust gas inlet (3) is provided with a restriction, preferably in the form of a cone (6). Thereby, an intake of a suitable amount of air is achieved through an air inlet (7), preferably comprising an air labyrinth (8). The catalytic substance (14) is preferably provided in pellet form and arranged in an annular chamber in the housing, having a circular shape. A muffling substance (16) made of glass fibre ceramics is preferably arranged in a chamber (15) outside of the catalytic substance (14).

11 Claims, 1 Drawing Sheet

COMBINED CATALYTIC CONVERTER AND MUFFLER

FIELD OF THE INVENTION

The present invention relates to a combined catalytic converter and muffler device. Said device is primarily intended for lawn mower applications, but can also be applied for other smaller engines. The device consists of a housing within which a catalytic substance is applied. The exhaust gases are brought to pass through the catalytic substance together with air, in order to achieve further combustion and reactions.

STATE OF THE ART

Combined catalytic converters and mufflers are as such, previously known. They commonly use a monolithic catalytic material in the shape of a honeycomb structure. Such a structure entails that gases can only flow in one predetermined direction through the material. This in turn causes restrictions to the design of the device, which makes it cumbersome. Such a catalytic material is also relatively expensive.

In order to regulate the inflow of air to the catalytic converter, valves or flaps at the air inlet have been used, also complicating the design.

The present invention is a new design using a catalytic material in the form of pellets. By designing the gas ducts in a suitable manner, no flaps or moving parts at the air inlet are necessary.

SUMMARY OF THE INVENTION

The present invention thus provides a combined catalytic converter and muffler device to be fitted to the exhaust pipe of a combustion engine. Said device comprises a housing within which a catalytic substance is arranged.

According to the invention, the exhaust inlet is provided with a restrictor, preferably in the shape of a cone at the exhaust inlet. Thereby, a correct suction flow of air through the air inlet is achieved, said inlet preferably comprising an air labyrinth.

According to the preferred embodiment, the catalytic substance has pellet form and is arranged within an annular chamber in the housing, having a circular shape.

Other embodiments of the invention are described in further detail in the appended claims.

BRIEF DESCRIPTION OF THE DRAWINGS

The invention will be described in detail below, with reference to the enclosed drawings, in which.

DETAILED DESCRIPTION OF PREFERRED EMBODIMENTS

The invention thus relates to a combined catalytic converter and muffler for small engines, e.g. for lawn mowers, chain saws and the like. Today, these engines generally lack efficient emission control, and consequently there is a great need for such a device. The present device may of course be used on new engines as well as be retro-fitted on used engines.

The device is to be attached to the engine exhaust pipe where a conventional muffler was previously fitted. The device according to the invention has a special design of the exhaust inlet, causing air to be entrained through a special air inlet. Within the same housing, a catalytic substance is located. The auxiliary air is necessary for the combustion within the catalytic substance in order to reduce the dangerous emissions. In the same housing, there is also a further substance for the achievement of muffling and cooling of the hot exhaust gases.

Figure 1:
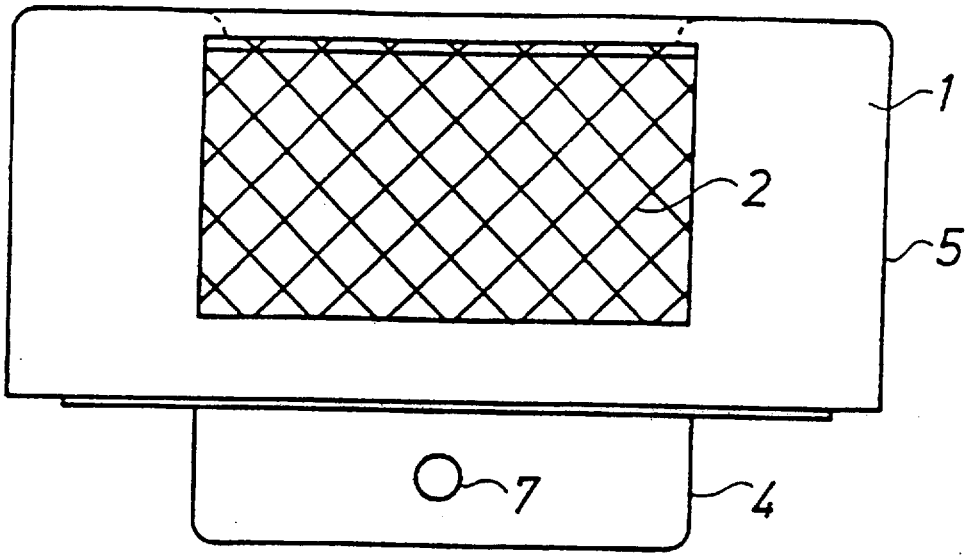
FIG. 1 shows a side view of the combined catalytic converter and muffler device according to the present invention.

FIG. 1 shows a side view of the housing 1. Said housing is circular, seen from above, and has an exhaust outlet 2 arranged over a certain part of the circumference. The exhaust outlet is equipped with a wire net or similar. When fitted to the the engine, the exhaust outlet 2 is to be turned away from the user, i.e forward in the case of lawn mowers.

Figure 2:
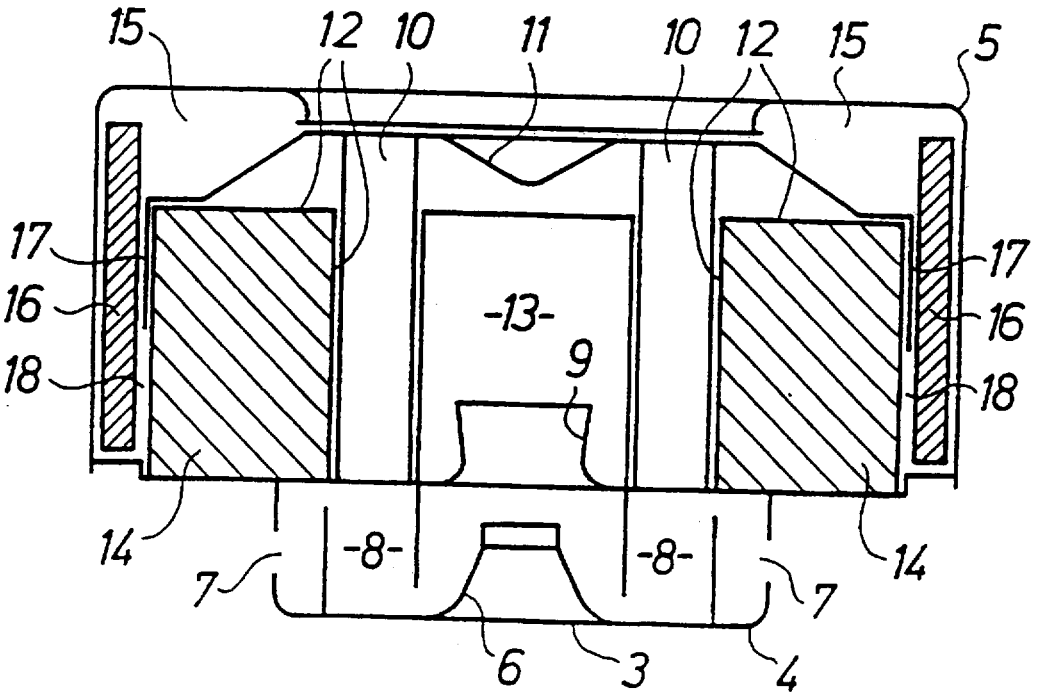
FIG. 2 is a cross section view of the device.

FIG. 2 shows a cross section through the device according to the invention. Said device preferably consists of two cylindrical sections, a smaller section 4 and a larger section 5. The smaller section 4 is attached to the engine exhaust pipe (not shown) by means of Screws or the like, passing through holes 10 crossing through the whole housing. The exhaust gases are forced by the engine through an exhaust inlet 3 having a restriction in the shape of a cone 6. Said cone 6 causes, through the high gas velocity, an ejector effect in the area inside the cone 6.

The smaller section 4 also comprises an air inlet consisting of a number of holes 7 distributed around the circumference of the smaller section 4. The holes are preferably four in number. Due to the cone 6, the exhaust gases obtain a suitable speed so as to entrain air through the air inlet 7 and through an air labyrinth 8 arranged in the smaller section 4. Said labyrinth 8 is primarily arranged muffle the inlet noise. In this way, the arranging of flaps at the air inlet, which has been used in the previously known technology, is avoided.

The exhaust gas-air mixture enters through a second cone 9 into an inner chamber 13 of the larger section. Through the ejector effect from this cone 9, the gas mixture will spread and bounce off an upper cone 11 and then move outwards and downwards.

Around the inner chamber 13 there is an annular chamber, filled with a catalytic substance 14. The wall 12 between the inner chamber 13 and the catalytic substance 14 is perforated by holes or gratings so that the gas mixture may pass into the catalytic substance. The catalytic substance is of a conventional type and commercially available. Said catalytic substance has pellet form and the gas mixture may thus pass in any direction between the pellets. The catalytic substance 14 starts to glow and will reach a working temperature of 550 (C within a few minutes.

The cleaned exhaust gases pass from the catalytic substance through the wall 17, which has perforations 18 in the form of holes or gratings at the lower edge. The outer chamber 15 surrounds the catalytic substance on the sides as well as partly above said substance and is in connection with the exhaust outlet 3, shown in FIG. 1. The outer chamber 15 contains a further substance 16 serving to further muffle the sound, to cool the hot exhaust gases and to protect against any sparks coming from the catalytic substance. This substance preferably consists of a strip of glass wool or glass fibre ceramics. This is an as such previously known material, but it has not been used in this context.

The present invention thus provides a compact apparatus for exhaust gas cleaning and muffling. Due to the codes arranged at the exhaust gas inlet and in the inner chamber, a correct gas speed and mixture is obtained. During tests with the device, no less than 86% cleaning rate has been achieved. The external shape of the housing does of course not have to be cylindrical, but may be rectangular or have other regular or irregular shapes depending on the space available etc. The cylindrical shape is however the most advantageous from a manufacturing point of view. Other modifications to the device will be evident to the professional and are considered as falling within the scope of the appended claims.

I claim:

1. A combined catalytic converter and muffler device for attachment to the exhaust pipe of a combustion engine; comprising a housing comprising a chamber for a catalytic substance;

b) an exhaust gas inlet having a restriction;

c) an air inlet disposed with respect to the exhaust gas inlet such that exhaust gases entering the exhaust gas inlet and passing through the restriction induce a suction of air through the air inlet whereby to form an exhaust gases-air mixture that passes through the catalytic substance, said air inlet comprising labryinth means for directing air sucked into the device to the exhaust gases along a circuitous path so as to limit inlet noise; and d) a muffling substance disposed in a path of the exhaust gases downstream of the catalytic substance.

2. A device according to claim 1 wherein the restriction is in the form of a cone at the exhaust inlet.

3. A device according to claim 1, wherein the muffling substance consists of glass wool.

4. A device according to claim 1, wherein the housing comprises two substantially cylindrical sections, one section having a small diameter and comprising the exhaust inlet and the air inlet, and the other section having a larger diameter and comprising the catalytic substance and an exhaust outlet (2).

5. A device according to claim 4, wherein the exhaust inlet is arranged in the center of the smaller section and wherein the air inlet comprises a number of holes in the circumference of the smaller section (4).

6. A device according to claim 4, wherein the exhaust outlet is arranged on one side of the circumference of the larger section.

7. A device as claimed in claim 1, wherein the chamber comprises a catalytic substance in pellet form.

8. A device as claimed in claim 7, wherein the chamber is annular.

9. A device as claimed in claim 8, wherein the annular chamber surrounds an inner chamber through which exhaust gases entering the exhaust gas inlet pass, said inner chamber comprising a cone disposed at an upper portion thereof to deflect the exhaust gases outwardly and downwardly in the direction of the catalytic substance in the annular chamber.

10. A combined catalytic converter and muffler device for attachment to the exhaust pipe of a combustion engine, comprising a) a housing comprising an annular chamber for a catalytic substance and an inner chamber, said annular chamber surrounding the inner chamber;

b) an exhaust gas inlet having a restriction;

c) an air inlet disposed with respect to the exhaust gas inlet such that exhaust gases entering the exhaust gas inlet and passing through the restriction induce a suction of air through the air inlet whereby to form an exhaust gases-air mixture that passes through the catalytic substance wherein the air inlet comprises labyrinth means for directing air sucked into the device to the exhaust gases along a circutious path so as to limit inlet noise; and d) cone means disposed at an upper portion of the inner chamber for deflecting exhaust gases outwardly and downwardly in the direction of the catalytic substance in the annular chamber.

11. A device as claimed in the claim 10 wherein the annular chamber comprises the catalytic substance in pellet form.

* * * * *